United States Patent [19]

Madsac

[11] Patent Number: 4,713,215

[45] Date of Patent: Dec. 15, 1987

[54] PROCESS FOR SINTERING POWDERED MATERIAL IN A CONTINUOUS FURNACE

[75] Inventor: Michel Madsac, Sceaux, France

[73] Assignee: L'Air Liquide, Paris, France

[21] Appl. No.: 49,850

[22] Filed: May 15, 1987

[30] Foreign Application Priority Data

May 16, 1986 [FR] France ..... 86 07067

[51] Int. Cl.[4] ..... B22F 7/00

[52] U.S. Cl. ..... 419/8; 419/9; 419/19; 419/43; 419/53; 419/54; 419/57; 419/58; 264/125; 264/60; 264/65

[58] Field of Search ..... 419/8, 9, 19, 43, 53, 419/54, 57, 58; 264/60, 65, 125

[56] References Cited

U.S. PATENT DOCUMENTS

| | | | |
|---|---|---|---|
| 3,888,663 | 6/1975 | Reichman | 419/54 |
| 3,979,234 | 9/1976 | Northcutt et al. | 419/54 |
| 4,137,106 | 1/1979 | Doi et al. | 419/54 |
| 4,139,375 | 2/1979 | Solomon et al. | 419/58 |
| 4,225,344 | 9/1980 | Fujimori et al. | 419/15 |
| 4,436,696 | 3/1984 | Buck et al. | 419/58 |
| 4,448,747 | 5/1984 | Moritoki et al. | 419/55 |
| 4,614,638 | 9/1986 | Kuroishi et al. | 419/19 |

*Primary Examiner*—Stephen J. Lechert, Jr.
*Attorney, Agent, or Firm*—Lee C. Robinson, Jr.

[57] ABSTRACT

The powdered material contains oxygen in the oxide and/or adsorbed form and the oxygen present is reduced in a first pre-sintering stage and the cohesion of the material is ensured in a second sintering stage. The pre-sintering stage is carried out under a reducing atmosphere based on hydrogen and neutral gas whose flow rate $F_G$ is higher than or equal to:

$$F_G \geqq \frac{1.4 \times S_P \times D_P}{P(H_2)i - P(H_2)f} \times \frac{X(O_2)i}{\alpha} \times v_S$$

in which relation:

$S_P$=section of the layer of powder to be sintered in sq.m $D_P$=voluminal mass of the powder in kg/cu m $X(O_2)i$=percentage of oxygen mass in the powder before the pre-sintering stage, in the oxide and/or adsorbed form, $P(H_2)i$=voluminal percentage of hydrogen in the gas introduced into the furnace, $P(H_2)f$=the smallest voluminal percentage of hydrogen in the atmosphere in the furnace at a point where the oxides have been completely reduced, $v_S$=speed of feed of the material in the furnace expressed in m/hr, $\alpha$ is a constant $F_G$ being expressed in cu.m/hr.

5 Claims, No Drawings

PROCESS FOR SINTERING POWDERED MATERIAL IN A CONTINUOUS FURNACE

The present invention relates to a process for sintering in a continuous furnace a powdered material containing oxygen in the oxide and/or adsorbed form, in which the oxygen present is reduced in the course of a first pre-sintering stage and then the cohesion of the powdered material is ensured in the course of a second sintering stage.

The sintering operations are usually carried out in continuous furnaces under a controlled atmosphere. Atmospheres are increasingly used which are based on nitrogen in these sintering furnaces for replacing atmospheres produced by exothermic generators or by ammonia crackers, on one hand because the flow rate of synthetic atmospheres is easier to regulate and on the other hand because their composition may be modified in accordance with the characteristics of the process. Further, exothermic generators have a very variable dew point and a large quantity of hydrogen is required in the atmosphere of the furnace to maintain the reducing character of this atmosphere and avoid oxidation of the powdered material or of the support on which the latter is sintered.

Another function of the protective atmosphere in heat treating furnaces is the creation of a positive pressure in the furnace which will limit the entry of air in the critical regions of the furnace to avoid oxidation. A currently-used protective atmosphere contains inert gases such as nitrogen and reagent gases capable of reducing the oxides, such as hydrogen and/or carbon monoxide.

Most metallic powders contain oxides owing to the conditions of production and storage of the latter. The thermal treating atmospheres must be capable of reducing these atmospheres. This factor is critical since the layers of oxide hinder the sintering procedure. The composition of the atmosphere must therefore be adapted for the reduction of the surface oxides and the free oxygen contained within the powdered material.

However, the well-known advantages of synthetic atmospheres over atmospheres created from exothermic generators may sometimes be found insufficient bearing in mind the higher cost of said synthetic atmospheres.

However, the applicant has found that it is unnecessary to use the same atmospheres, and/or the same rates of flow of the atmospheres for the pre-sintering and sintering operations, which cannot be achieved when a generator is used for producing the pre-sintering and sintering atmospheres.

The pre-sintering stage, in particular in the absence of a binder between the various powder grains, has for purpose to reduce the oxides present in the powder and generally reduce the oxygen present in the layer of powder. Consequently, the atmosphere must have the required reducing qualities.

The sintering stage has in particular for purpose to increase the intergranular cohesion and the diffusion at the interface between the grains and the support when the sintering is carried out on a distinct support. This sintering stage also requires an atmosphere having a reducing character avoiding entry of air in the hot region and the oxidation of the powder which would hinder the sintering of the latter.

Based on this analysis, it has been found that the presintering stage is the stage of the process on which depends the productivity of a production line for a given quality of the sintering.

The process according to the invention enables the total flow of synthetic gas in the pre-sintering furnace to be determined as a function of the speed of feed of the material in the furnace, this speed being the same in the presintering furnace and the sintering furnace.

The process according to the invention is characterised in that the pre-sintering stage is carried out under a reducing atmosphere based on hydrogen and neutral gas whose flow rate $F_G$ is higher than or equal to:

$$F_G \geqq \frac{1.4 \times S_P \times D_P}{P(H_2)i - P(H_2)f} \times \frac{X(O_2)i}{\alpha} \times v_S$$

in which relation:

$S_P$=section of the layer of powder to be sintered in sq.m $D_P$=voluminal mass of the powder in kg/cu.m $X(O_2)i$=percentage of oxygen mass in the powder before the pre-sintering stage in the oxide and/or adsorbed form, $P(H_2)i$=voluminal percentage of hydrogen in the gas introduced into the furnace, $P(H_2)f$=the smallest voluminal percentage of hydrogen in the atmosphere in the furnace at a point where the oxides have been completely reduced, $v_S$=speed of feed of the material in the furnace expressed in m/hr, $\alpha$ is a constant, $F_G$ being expressed in cu.m/hr All the parameters of this formula are determined as a function of the furnace and of the powder to be sintered.

The parameter $P(H_2)f$ is the smallest value measured at a point of the furnace corresponding to the total reduction of the oxides, the rate of flow of the atmosphere being sufficient to ensure the complete reduction of the oxides and a sintering and adherence corresponding to a predetermined value.

The parameter $X(O_2)i$ is measured in accordance with the usual techniques for ascertaining the content of oxygen in a powdered mixture.

The coefficient $\alpha$ is determined in the following manner: an atmosphere of hydrogen and nitrogen is injected in the conventional manner into the sintering furnace, for example in the manner conventionally employed with an exothermic generator. There is added to the injected gas, for example 5% by volume of a "tracer" gas such as helium, for a given period of time, for example 10 minutes. The evolution of the content of helium in the gas escaping from the furnace as a function of time is recorded at the inlet and outlet of the furnace. This content of helium is integrated as a function of time at the inlet and outlet of the furnace, respectively (He) and (He). The coefficient $\alpha$ is equal to $(He)_i/((He)_i+(He)_o)$.

When the material to be sintered is the form of pieces in juxtaposed side-by-side relation to each other on the conveyor belt of the furnace, $S_P$ represents the mean section of the pieces in the plane perpendicular to the conveyor belt of the furnace.

A better understanding of the invention will be had from the following examples of carrying out the invention, to which the scope of the invention is not intended to be limited:

EXAMPLE 1

There is deposited on a sheet of carbon steel used as a support a layer of 0.9 mm of a powder containing 73% copper, 23% lead and 4% tin. The width of the support on which the powder is deposited is 200 mm, the voluminal mass of the powder is 5.2 T/ CU.M and the percentage of oxygen in the powder is 0.2%.

The band is fed through the furnace at a speed $v_S$, this furnace being constituted by a pre-sintering furnace having a length of 30 meters and a temperature of 820° C. at the outlet of which the sheet and the powder are rolled between two steel rolls and then introduced into the sintering furnace (length 30 meters—820° C.), each pre-sintering and sintering furnace having a cooling region 10 meters long (water-jacket type).

The atmosphere is injected into the pre-sintering and sintering furnaces in the vicinity of the junction between the hot and cooling regions.

An atmosphere containing 10% hydrogen and 90% nitrogen is injected into the pre-sintering furnace.

By using a flow rate of 30 cu.m/hr in the pre-sintering furnace, $P(H_2)f$ is measured as defined above. The measured value is 2.8%. The coefficient $\alpha$ is found to measure 30%.

By applying the aforementioned formula, the following is determined:

$$F_G \geqq \frac{v_S}{5.9}$$

In order to increase as far as possible the speed of the process, the flow rate of 30 cu.m/hr of atmosphere containing 10% $H_2$ by volume and 90% $N_2$ by volume is maintained.

A sintering speed is obtained which must remain lower than $5.9 \times 30 = 177$ meters/hour.

By adopting a speed slightly lower than this speed (about 160 m/hr), it is checked that a material is obtained which has the predetermined sintering qualities identical to those obtained by the use of an exothermic generator producing an atmosphere containing 10% hydrogen, 8% CO, 6% $CO_2$ and 76% $N_2$ at a flow rate of 30 cu.m/hr as concerns both the pre-sintering furnace and the sintering furnace but with a speed of feed of the material of about 110 m/hr. The gain in the speed of the process according to the invention is therefore about 50%.

But it has also been found that it is possible to reduce the gas flow rate in the sintering furnace to a value of about 15 cu.m/hr by means of a mixture which contains only 5% $H_2$ and 95% $N_2$ with the obtainment of the same predetermined qualities of the sintering of the material.

The process according to the invention permits accelerating the speed (for a constant flow rate) or reducing the flow rate (at constant speed) in the pre-sintering furnace, but also permits reducing the gas flow in the sintering furnace with an atmosphere containing less hydrogen, which gives the overall result of a large reduction in the production costs.

Such bands are of use as self-lubricating bearing bushes.

EXAMPLE 2

A layer of 0.7 mm of nickel powder is deposited on a sheet of pre-nickeled carbon steel used as a support.

The width of the support on which the powder is deposited is 150 mm, the voluminal mass of the powder is 0.8 T/Cu.M and the percentage of oxygen in the powder is 0.18%.

The band travels at the speed $v_S$ in the furnace, constituted by a hot region having a temperature of 1040° C. and a length of 4 m, followed by a cold region of the water-jacket type.

The atmosphere is injected into the furnace at the junction between the hot region and the cold region and at the end of the cold region. It is constituted by 10% hydrogen and 90% nitrogen.

By using a flow rate of 6 cu.m/hr in the furnace, P(H )f is measured as defined above. The measured value is 7.5%.

The coefficient $\alpha$ is determined as previously indicated: the measured value is 20%.

By applying the aforementioned formula, the following is determined:

$$F_G \geqq \frac{v_S}{23.6}$$

In order to increase as far as possible the speed of the process, the flow rate of 6 cu.m/hr of atmosphere containing 10% $H_2$ by volume and 90% $N_2$ by volume is maintained.

A sintering speed is obtained which must remain lower than $23.6 \times 6 = 141$ meters/hour.

In adopting a speed slightly lower than this speed (about 120 m/hr), there is obtained a material having the predetermined sintering qualities identical to those obtained when using an ammonia cracker-burner producing an atmosphere containing 10% hydrogen and 90% nitrogen at a flow rate of 6 cu.m/hr but with a speed of feed of the material of about 80 m/hr.

such bands are of use as porous electrodes for alkaline batteries.

What is claimed is:

1. A process for sintering in a continuous furnace a powdered material containing oxygen in the oxide and/or adsorbed state, comprising reducing the oxygen present in a first pre-sintering stage and then ensuring a cohesion of the material in second sintering stage, said pre-sintering stage being carried out under a reducing atmosphere based on hydrogen and neutral gas having a flow rate $F_G$ which is at least equal to:

$$F_G \geqq \frac{1.4 \times S_P \times D_P}{P(H_2)i - P(H_2)f} \times \frac{X(O_2)i}{\alpha} \times v_S$$

$S_P$=section of a layer of said powdered material to be sintered in sq.m $D_P$=voluminal mass of said powdered material in kg/cu.m $X(O_2)i$=percentage of oxygen mass in said powdered material before said pre-sintering stage in the oxide and/or adsorbed form, $P(H_2)i$=voluminal percentage of hydrogen in the gas introduced into the furnace, $P(H_2)f$=the smallest voluminal percentage of hydrogen in the atmosphere in the furnace at a point where the oxides have been completely reduced, $v_S$=speed of feed of the material in the furnace expressed in m/hr, $\alpha$ is a constant $F_G$ being expressed in cu.m/hr

2. A sintering process according to claim 1, wherein said powdered material is constituted by at least one metallic oxide.

3. A sintering process according to claim 1, wherein said powdered material is constituted by at least one metal.

4. A sintering process according to claim 1, comprising sintering said powdered material on a metal support.

5. A sintering process according to claim 1, wherein the atmosphere produced when sintering in said second stage said powdered material in the sintering furnace is an atmosphere also containing hydrogen and a neutral gas whose concentration of hydrogen is less than the concentration of hydeogen in the pre-sintering atmosphere.

* * * * *